United States Patent [19]

Hatton et al.

[11] 4,017,387

[45] Apr. 12, 1977

[54] SCREENING APPARATUS

[75] Inventors: Derald R. Hatton; Donald F. Lehman, both of Middletown, Ohio

[73] Assignee: The Black Clawson Company, Middletown, Ohio

[22] Filed: Aug. 11, 1975

[21] Appl. No.: 603,304

[52] U.S. Cl. ..... 209/240; 209/273; 209/306; 209/379; 209/399

[51] Int. Cl.[2] ..... B07B 1/04

[58] Field of Search ..... 210/497.1, 457, 415; 209/306, 273, 399, 270, 379, 406, 240

[56] References Cited

UNITED STATES PATENTS

| | | | |
|---|---|---|---|
| 2,820,549 | 1/1958 | Belke | 210/497.1 X |
| 3,200,952 | 8/1965 | Jardin | 210/457 |
| 3,229,815 | 1/1966 | Mathewson | 209/270 X |
| 3,456,793 | 7/1969 | Salomon | 210/415 X |
| 3,458,038 | 7/1969 | Young | 209/306 X |
| 3,511,374 | 5/1970 | Beal | 209/273 X |
| 3,631,981 | 1/1972 | Young | 209/399 |
| 3,726,401 | 4/1973 | Bolton | 209/273 X |
| 3,825,123 | 7/1974 | Neuman | 209/273 X |

*Primary Examiner*—Robert Halper
*Attorney, Agent, or Firm*—Biebel, French & Nauman

[57] ABSTRACT

In a screening machine of the type having a perforated cylinder through which the material being screened is passed and a rotor for maintaining the cylinder perforations open, failure of the cylinder due to torsional forces imposed on it by rotation of the rotor is prevented by providing several beam-like cantilevers which extend longitudinally of the cylinder and resist the twisting, torsional forces imposed on the cylinder during screening operations. Intermediate reenforcing rings, which are designed to withstand radially directed loads imposed on the cylinder, are restrained against movement longitudinally of the cylinder by means of clips which are welded to the cantilevers on opposite sides of each of the rings. The cantilevers, therefore, also serve as an area on the cylinder to which the clips can be welded, eliminating the necessity of making welds at undesirable locations near perforated portions of the cylinder. The number of foils carried by the rotor and the number of cantilevers are selected such that there is an odd number of one and an even number of the other to avoid having all cantilevers receive a radial load simultaneously as would occur if the foils passed simultaneously all of the cantilevers.

5 Claims, 8 Drawing Figures

SCREENING APPARATUS

BACKGROUND OF THE INVENTION

One form of screening apparatus which has received wide spread acceptance, particularly in the paper industry, is that which includes a perforated cylinder through which the material is screened and a rotor for maintaining the cylinder perforations open. Screens of this general type are described in U.S. Pat. No. 2,835,173 and 3,849,302. Additionally, U.S. Pat. No. 3,713,541 discloses a screen having a particular slot pattern.

A problem which is characteristic of screens of this type, however, is cracking of the screen cylinder. The perforated screen cylinders, in most applications, are used in environments which require materials of construction which are highly susceptible to fatigue failure. This is compounded by the severe forces imposed on the cylinder by the rotor, and is particularly true where the rotor comprises foils which generate alternate positive and negative pressures as they move along a face of the screen cylinder, resulting in a cyclic, pulsing load being imposed on the cylinder.

To combat the cycle loads generated by the rotor, the cylinder is often provided with circumferentially extending, unperforated bands and, particularly in high speed, high capacity units, reenforcing bands which encircle the screen cylinder and are attached thereto by welding.

One type of failure has been noted, however, which is not obviated by the use of reenforcing rings. This failure, which also involves cracking, is noticed initially adjacent the end of the cylinder where it is attached to the main casing enclosing the cylinder. Despite the frequency with which this type of failure occurs, efforts to determine the cause of and find a solution to these latter failures have been largely unsuccessful, and the conventional response has been merely to accept the fact that failures of this type are inevitable and simply to replace the screen cylinder upon failure.

Additionally, welding of the intermediate reenforcing rings to the screen cylinder to resist radial stresses often creates flaws in the cylinder at undesirable areas near the perforated areas of the screen and undoubtedly contributes to screen failure.

SUMMARY OF THE INVENTION

The present invention provides a solution to screen cylinder cracking failures of the type which have not been remedied by reenforcing rings while simultaneously permitting greater flow rates and providing a solution to the problem of the welding-created flaws which occur during the attachment of reenforcing rings to the screen cylinder.

Specifically, the solution of the present invention was conceived as a result of the discovery that the cracking occurring in the screen cylinder which did not appear to be prevented through the use of reenforcing rings, occurred as a result of the torsional forces imposed on the screen cylinder by the action of the rotor. This force appears to twist the screen cylinder about its axis, and since the screen cylinder is generally attached at one end, such as its upper end, high stress concentrations are imposed on the cylinder.

This was particularly experienced at the weld seam normally found in cylinder screens. Cylinder screens are normally perforated as a flat plate and then rolled and ends of the rolled plate welded together to form a cylinder. Even though the calculated stress levels for such structures fall well within accepted practice, the unperforated area of the cylinder at the weld seam continued to fail.

Despite the fact that it was the unperforated portions of the cylinder that experienced the greatest incidence of failure, applicant decided, rather than attempting to eliminate this unperforated area, which would have involved additional, expensive manufacturing operations, to provide additional unperforated areas extending longitudinally of the screen cylinder, cantilevered from a fixed end of the cylinder.

Thus, in accordance with the present invention, unperforated, longitudinally extending areas are provided in the screen cylinder extending from a fixed end of the cylinder and acting as cantilever beams to resist the twisting, torsional forces exerted on screen cylinders by operation of the rotor. The cantilevers may extend longitudinally of the screen cylinder at an angle to the axis of the cylinder or parallel thereto, in either case resisting torsional loads applied thereto. In this way screen cylinders can be used without cracking at a thickness at which cracking had heretofore been encountered, rendering practical the manufacture of screen cylinders from plate material having a thickness on the order of ⅛ to ½ inch.

A further benefit obtained from the cantilevered construction is the provision of circumferentially spaced, unperforated areas in the cylinder where the intermediate reenforcing rings can be attached without generation of weld created flaws in perforated portions of the basket.

In a preferred embodiment of the invention, the intermediate reenforcing rings are attached by means of clips which are welded to the cantilevers on opposite sides of the intermediate reenforcing rings and prevent movement of the rings axially of the screen cylinder.

It has also been found that the intermediate reenforcing rings act as guides for the cantilevers in the structural sense, and prevent twisting of the cantilevers about their axes as loads normal to their axes are applied to the cantilevers. The number of foils carried by the rotor and the number of cantilevers are selected such that there is an odd number of one and an even number of the other to avoid having all cantilevers receive a radial load simultaneously as would occur if the foils passed simultaneously all of the cantilevers.

These and other advantages of the present invention will become more apparent from the following detailed description.

DESCRIPTION OF THE PREFERRED EMBODIMENT

Figure 1:
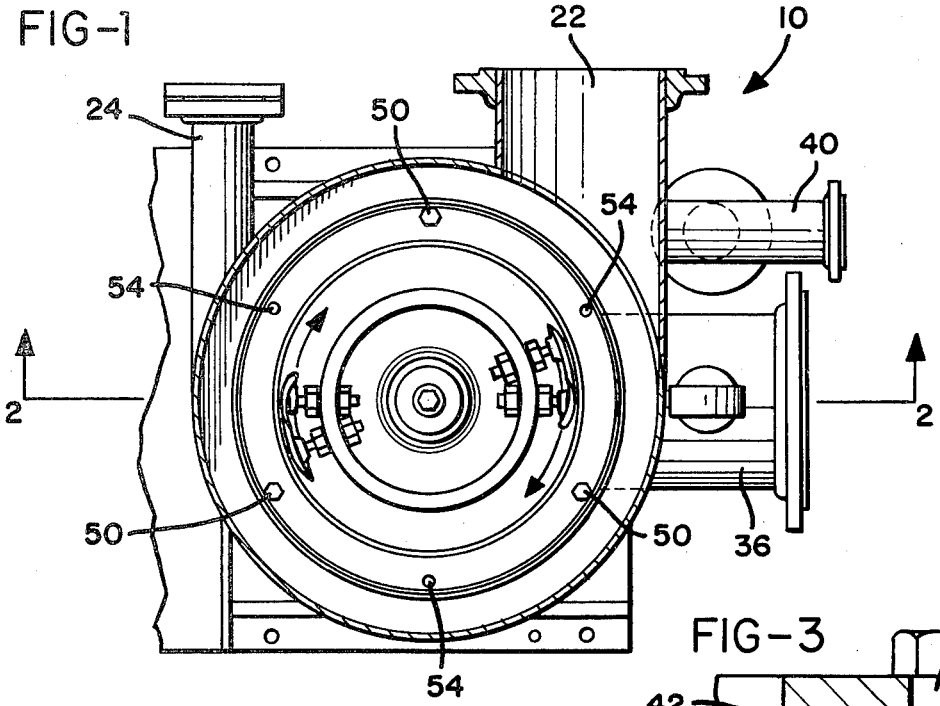
FIG. 1 is a top view of a screening machine in accordance with the present invention viewed generally along line 1—1 of FIG. 2.
Figure 2:
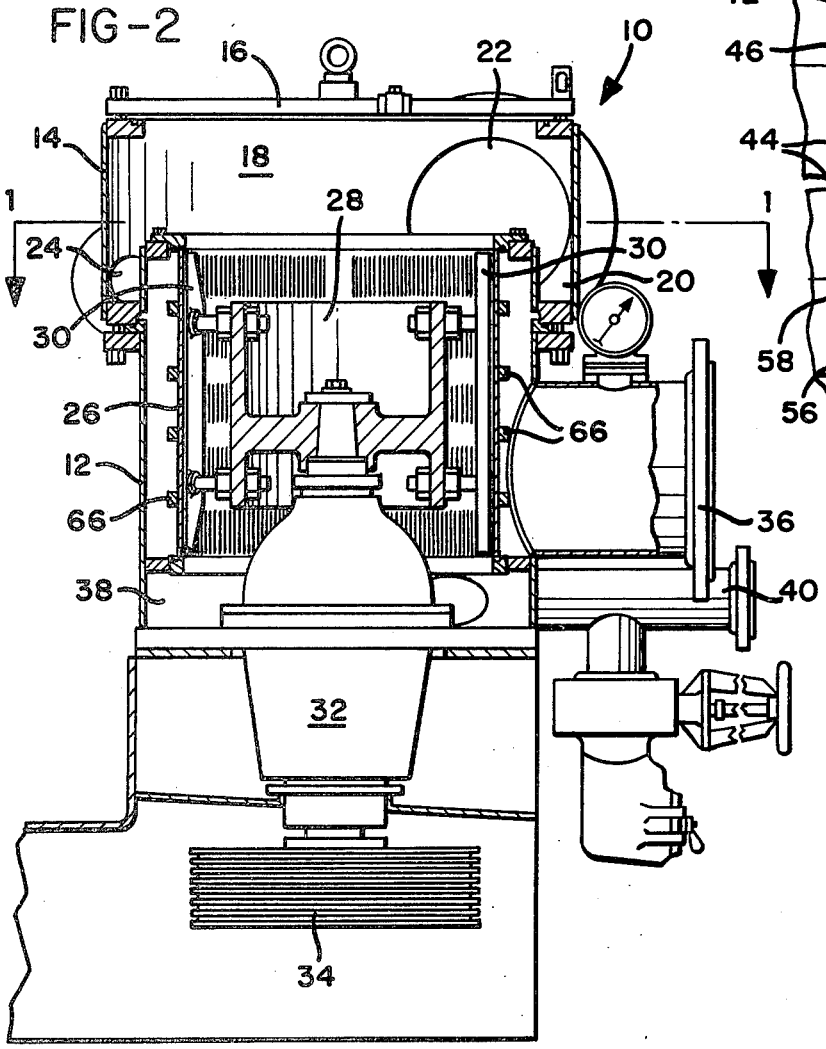
FIG. 2 is a partial cross-sectional view taken along line 2—2 of FIG. 1.

With reference initially to FIGS. 1 and 2, it will be seen that a screening machine 10 in accordance with the present invention includes a main casing 12 of generally cylindrical configuration having an upper, inlet section 14 closed by a top cover 16 and defining therewith an inlet chamber 18 having an annular trough 20.

An inlet 22 feeds into the chamber 18 for conveying thereto a material to be screened, such as paper making pulp, and a clean-out line 24 communicates with the trough 20 to permit removal of material which accumulates in the trough.

Mounted substantially concentrically within the main casing 12 is a perforated screen cylinder 26, and mounted within the cylinder 26 for rotation about an axis coincident with the axis of the cylinder is a rotor 28, including an opposed pair of foils 30.

While the rotor is shown as consisting of a pair of opposed foils, it will be apparent that other types of rotors can be utilized to maintain the openings through the screen 26 open and that, when using a foil type rotor, the number of foils can be varied if desired.

The drive assembly 32 for the rotor 28 may include a sheave 34 wrapped by a plurality of V belts, not shown, which would also wrap the drive sheave of a suitable motor, also not shown.

Material passing through the perforations in the screen cylinder 26 is discharged from the screening machine through the outlet 36 while rejects pass into the bottom chamber 38 and are removed through the line 40.

Figure 3:
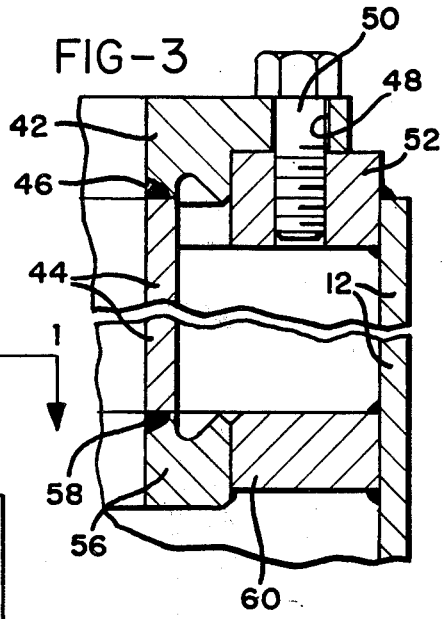
FIG. 3 is an enlarged view of a portion of FIG. 2 showing the connection of the top reenforcing ring to the main casing of the screening machine.
Figure 4:
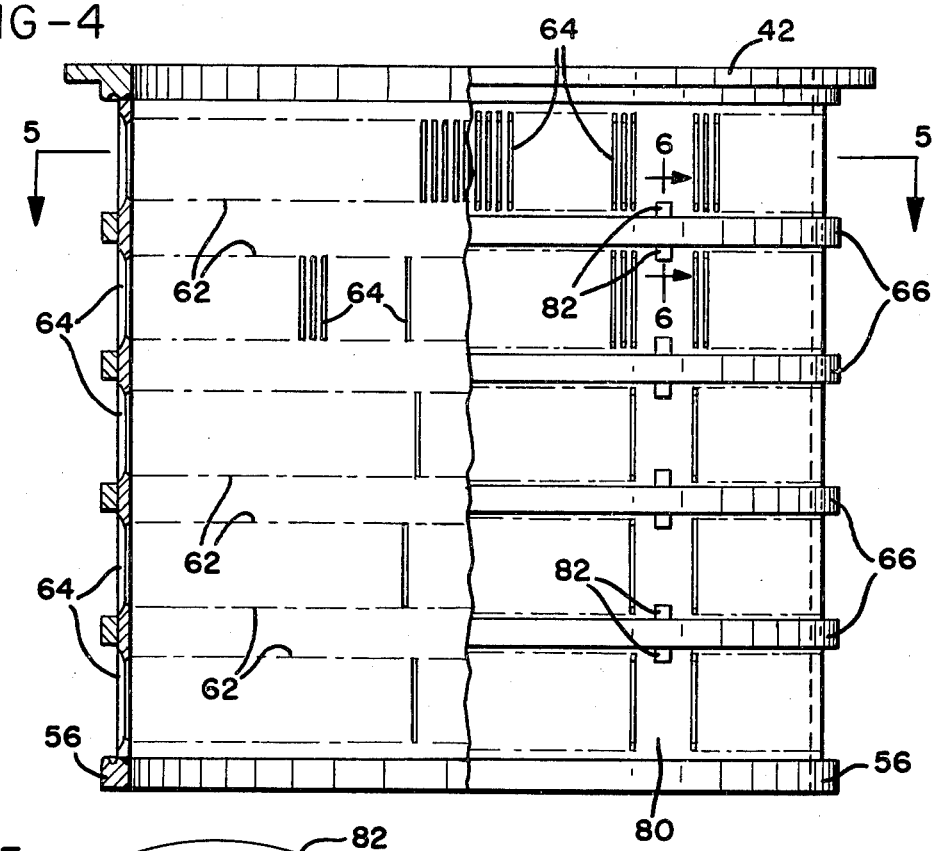
FIG. 4 is a view, partly in section, of a screen cylinder in accordance with the present invention.
Figure 5:
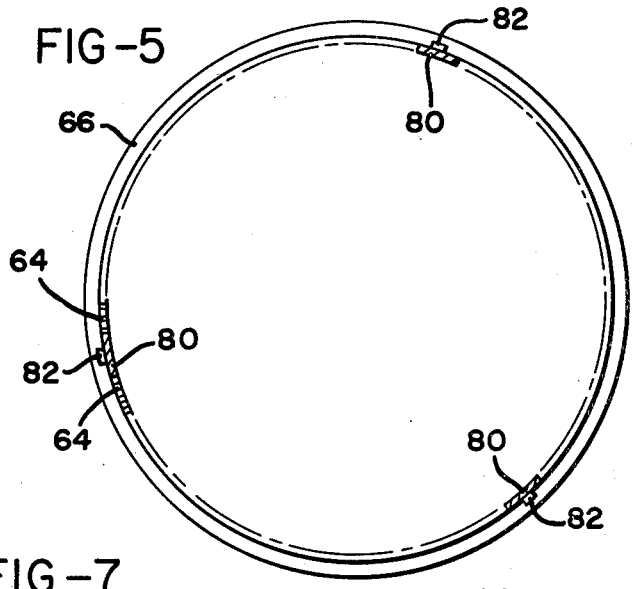
FIG. 5 is a view taken along line 5—5 of FIG. 4.

A top reenforcing ring 42, see also FIGS. 3 and 4, is attached to the upper end of the wall 44 of the screen cylinder by welding or the like, as indicated at 46 in FIG. 3 of the drawings. The top ring 42 is provided with a number of bolt holes 48 receiving bolts 50 to attach the screen cylinder to an annular ring 52 fixed to the main casing 12. Additional lift holes 54 may also be provided in the top ring to facilitate handling.

A bottom ring 56 is attached to the lower end of the wall 44 by means of welding or the like, as indicated at 58 in Fig. 3, and an outer face of the lower ring 56 engages the inner face of an annular ring 60 secured by welding or the like to a lower portion of the main casing 12.

With this construction, it will be seen that the screen cylinder 26 is restrained from movements normal to its axis by both the upper and lower annular members 52 and 60, and against movement about its axis by virtue of its being fixed at its upper end. Of course the screen could be fixed at its lower end against movement both normal to and about its axis and fixed at its upper end only against movement normal to its axis.

Figure 7:
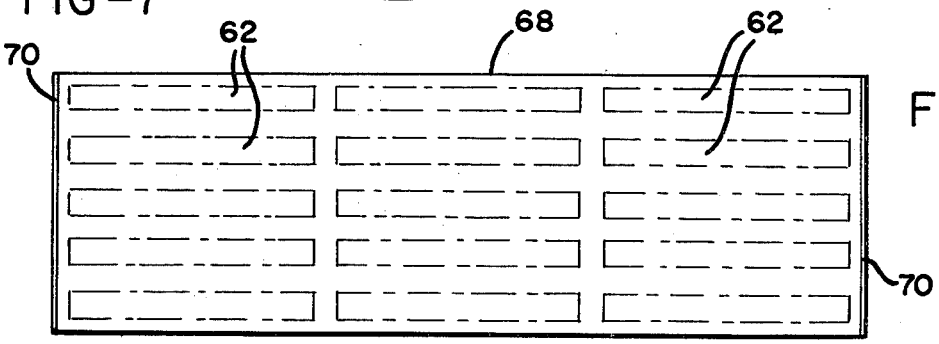
FIG. 7 is a plan view of a plate from which the screen cylinder is constructed.

The screen cylinder itself, as best seen in FIG. 4, consists of several bands 62 of perforations, a few of which are shown at 64 for purposes of illustration, it being understood that the dash-dot lines in FIGS. 4 and 7 are intended to represent schematically bands of such perforations.

The specific perforations are shown as elongated slots having their axes extending parallel to each other and to the axis of the screen cylinder 26 and being longer at the outer face of the screen cylinder than at the inner face thereof, although it will be apparent that other shapes of perforations may be used.

Intermediate reenforcing rings 66 encircle the screen 26 and provide reenforcement against the cyclic, pulsing action applied to the screen cylinder by the rotation of the rotor 28.

Figure 8:
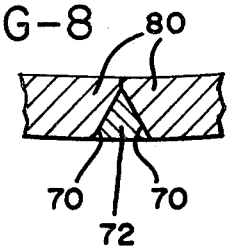
FIG. 8 is a cross-sectional view through the weld seam at the ends of the plate after it has been rolled into cylinder form.

In constructing the screen cylinder 26, a plate 68, as seen in FIG. 7, is provided with the bands of perforations 62 and then rolled to a cylinder form and its edges 70 welded, as indicated at 72 in FIG. 8. As discussed above, the thickness of plate 68 may be on the order of to ½ inch.

In accordance with the present invention, failures due to torsional loads which had been encountered in screen cylinders of normal plate thicknesses have been eliminated by providing cantilever sections 80 in the form of longitudinally extending, unperforated sections of the screen intermediate bands of perforations. The sections 80 cantilever out from the fixed end of the screen cylinder, illustrated as the upper end, across lines of torsional force imposed on the screen cylinder by the rotation of the rotor 68 and carry the torsional loads imposed on the cylinder while developing relatively low stress.

Figure 6:
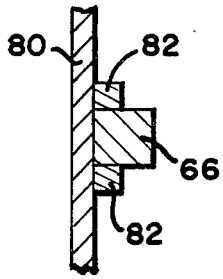
FIG. 6 is a cross-sectional view taken along line 6—6 of FIG. 4.

In addition to their function of resisting torsional loads, the cantilevers 80 also provide an area for attaching the intermediate reenforcing rings 66 to the screen cylinder and thus obviate the possibility of weld generated flaws in the apertured area of the cylinder. In a preferred method of attaching the reenforcing rings, as seen in FIG. 6, clips 82 are welded to the cantilevers 80 at opposite sides of each intermediate ring 66 and restrain the rings against movement axially of the cylinder.

In dealing with cantilever structures, there is a tendency for the cantilever to twist under load. When this occurs, the greatest depth of the cantilever is no longer situated in the plane of load applications and failure of the cantilever can result without its reaching its full load potential. To combat this tendency, guides are often provided. In the structure of the present invention, the intermdediate rings 66 function similarly to cantilever guides and ensure that the cantilevers 80 can reach their full design load.

The cylinder is shown as provided with three cantilevers, including the cantilever formed by welding the unperforated ends 70 of the plate 68, and the rotor is shown as provided with a pair of foils. Where the rotor consists of foils, bars or the like, it is believed desirable that either an even number of such foils or bars and an odd number of cantilevers be provided or an odd number of foils and an even number of cantilevers. This is to avoid having all cantilevers receive a radial load simultaneously, as would occur when the foils passed simultaneously all of the cantilevers.

From the above it will be seen that the present invention provides an improved screen machine in which reduced screen cylinder breakage is obtained.

While the form of apparatus herein described constitutes a preferred embodiment of the invention, it is to be understood that the invention is not limited to this precise form of apparatus, and that changes may be made therein without departing from the scope of the invention.

We claim:

1. In a screening machine including a main casing, a perforated screen cylinder disposed within said main casing, said cylinder having inner and outer faces, an inlet into said casing for directing material to be screened to said inner face of said cylinder, an outlet from said casing for removing from said casing screened material which has passed through said cylinder from said inner face to said outer face thereof, means fixing said cylinder to said casing to prevent rotation of said cylinder, and cleaning foils mounted for rotation within said cylinder adjacent said inner face of said cylinder to maintain said perforations unobstructed, the improvement comprising:

a plurality of uninterrupted, discrete slots extending completely through said cylinder from said inner to said outer face thereof, said slots being arranged in a plurality of circumferentially arranged bands extending about said cylinder, each of said bands being spaced from each other longitudinally of said cylinder, said bands being interrupted at spaced intervals by unperforated cantilevered sections extending longitudinally of said cylinder, and said cantilevered sections and said foils are of such number and arranged with respect to each other such that said foils and said cantilevered sections cannot be aligned with each other.

2. The screening machine of claim 1 wherein:

each of said slots is of greater length at said outer face of said cylinder than at said inner face thereof.

3. The screening machine of claim 1 wherein:

said cleaning foils comprise an even number of foils, and said cantilevered sections consist of an odd number of said sections.

4. The screening machine of claim 1 wherein:

said cleaning foils comprise an odd number of foils, and said cantilevered sections consist of an even number of sections.

5. The screening machine of claim 1 wherein:

said screen cylinder is ⅛ to ½ inch thick.

* * * * *